US006585267B2

(12) United States Patent
Webb

(10) Patent No.: US 6,585,267 B2
(45) **Date of Patent: *Jul. 1, 2003**

(54) APPARATUS AND METHOD FOR PLAYING A CARD GAME INCORPORATING WAGERS FOR DEALT HANDS AND HAND POSITIONS

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/984,500

(22) Filed: Oct. 30, 2001

(65) Prior Publication Data

US 2002/0027324 A1 Mar. 7, 2002

Related U.S. Application Data

(63) Continuation-in-part of application No. 09/533,794, filed on Mar. 24, 2000, now Pat. No. 6,343,789.

(51) Int. Cl.[7] ..... A63F 1/00
(52) U.S. Cl. ..... 273/274; 273/292
(58) Field of Search ..... 273/274, 292, 273/303; 463/11–13

(56) References Cited

U.S. PATENT DOCUMENTS 5,072,946 A 12/1991 Miller
5,257,810 A 11/1993 Schorr et al.
5,452,899 A 9/1995 Skratulia et al.
5,649,705 A 7/1997 String
5,839,731 A 11/1998 Feola
5,868,392 A 2/1999 Kraft
5,876,283 A 3/1999 Parra et al.
5,918,884 A 7/1999 DiMuro
RE36,739 E 6/2000 Gutierrez
6,343,789 B1 * 2/2002 Webb ..... 273/274

* cited by examiner

*Primary Examiner*—Benjamin H. Layno
*Assistant Examiner*—Vishu K Mendiratta
(74) *Attorney, Agent, or Firm*—Nixon & Vanderhye P.C.

(57) ABSTRACT

A modern version of an old gambling game enables players to wager on a particular card or hand being dealt into a first position or a second position. Wagers matching the first card or hand in the first position and wagers matching the second card or hand in the second position are paid. Wagers for matching ranks in the incorrect position are taken. If that particular card or hand does not appear, the wager stays in play for a next round. When the first card or hand is equivalent to the second card or hand, matching wagers win, and unmatching wagers are resolved according to characteristics of the first card or hand and the second card or hand, such as card suit, card color, whether the cards are odd or even or high or low, using a hand rank such as according to poker combinations, by a numerical computation of the hand with reference to prescribed rankings of high/low or odd/even or the like. The game incorporates a reasonable and consistent house advantage and a smooth method of operation, while being easy to understand and fun to play.

44 Claims, 2 Drawing Sheets

APPARATUS AND METHOD FOR PLAYING A CARD GAME INCORPORATING WAGERS FOR DEALT HANDS AND HAND POSITIONS

CROSS-REFERENCES TO RELATED APPLICATIONS

This is a continuation-in-part of U.S. patent application Ser. No. 09/533,794, filed Mar. 24, 2000, now U.S. Pat. No. 6,343,789 dated Feb. 5, 2002, the entire content of which is hereby incorporated by reference in this application.

STATEMENT REGARDING FEDERALLY SPONSORED RESEARCH OR DEVELOPMENT (NOT APPLICABLE)

BACKGROUND OF THE INVENTION

The present invention relates to an apparatus and method for playing a casino card game and, more particularly, to an enhanced casino version of an old gambling game that incorporates a novel mode of wager resolution.

Around a hundred years ago, the most popular casino game in the United States was Faro. Today, Faro is not operational anywhere. Unfortunately, the game attracted dishonest dealers and operators and so gained a bad reputation with players. When regulated gaming ensured that games were run fairly, Faro was regarded as a difficult game for casino operators to win at, and a 5% commission on winnings was introduced. With the growth of other casino games such as Craps, Blackjack and Baccarat, the game of Faro passed into gaming history.

The table layout consisted of thirteen bet areas, one for each of the thirteen ranks of standard playing cards, with suits being ignored. A player could bet either that a card could be a winner or that a card could be a loser. Betting that a card would be a loser was defined by placing a coin or marker on top of that wager. A single deck was used and dealt from a purpose-designed box. Two cards were exposed, being a first card and a second card, with the first card deemed to be the losing card and the second card deemed to be the winning card.

Player wagers on card ranks not shown remained in action until resolved on a subsequent round. Player wagers to win on the card rank showing first lose, whereas player wagers to win on the card rank showing second win. Player wagers to lose on the card rank showing first win, whereas player wagers to lose on the card rank showing second lose. The game was played with a single deck and dealt down to the end with an option for a proposition wager on the last three cards. In play, the first card of the deck and the last card of the deck would not be used. An abacus was used to record the play of each card.

The house advantage occurred whenever each of the two dealt cards was the same rank. In this case, all wagers on that rank would lose half the stake to the bank. Once three of a certain rank had been dealt, two of that same rank could not occur and there was no house advantage on a wager on that rank. Therefore, the commission concept was introduced. The combination of commission and house advantage earlier in the deck, however, makes the house advantage too high for play in the modem casino environment.

BRIEF SUMMARY OF THE INVENTION

In order to appeal to players and casinos, a modem version of Faro must have a reasonable and consistent house advantage and smooth method of operation. The proposed described invention seeks to address these requirements. The game according to the invention, so-called NuFaro, is preferably played with multiple decks of regular playing cards dealt from a standard shoe with a cut card inserted and/or a bum card before each deal, to ensure that not all cards come into play. The gaming table layout consists of two distinct betting areas, one for the first card and one for the second card. Each area contains betting options for each of the thirteen card ranks, providing a total of twenty-six betting areas.

Additional wager options for each of the first and second card may be available for black or red, high or low, odd or even, specific suits and other propositions. Jacks, Queens and Kings each receive odd, even or neutral ranking according to game embodiment rules. Also, Ace receives high, low or neutral ranking, and the subsequent middle card, either seven or eight, receives a neutral ranking, as determined by game embodiment rules.

By creating wager areas for each of the first and second hand or card, the complication of the marker coin has been removed. Also, the concept of a card being a loser has been removed. When a wager on a first card rank has been placed, that wager wins when that card rank shows as the first card, and loses when that card rank shows as the second card. When a wager on a second card rank has been placed, that wager wins when that card rank shows as the second card, and loses when that card rank shows as the first card.

When the card rank with wager(s) at either the first card position or the second card position does not show as either card, then those wager(s) push or stay in action. The wager may either be returned to the player or must be played until resolved depending on the embodiment operated. When the card rank with wager(s) at either the first card position or the second card position shows as both first and second, then the methodology of operating the house advantage applies.

In a preferred embodiment, wagers on that card rank win, while unmatching wagers are either (1) won by the house, (2) sometimes won by the house and sometimes pushed as a tie, (3) sometimes won by the house and sometimes won by the player, or (4) sometimes won by the house, sometimes won by the player and sometimes pushed as a tie.

A preferred methodology of allocation of results is to utilize standard black and red cards and suit as relevant characteristics. For example, in scenario (2), a result of unmatched wagers may be a tie on either same suit or same color with others being losses respectively; in scenario (3), unmatched wagers win for the same suit, with unsuited cards being a loss; or in scenario (4), which is a preferred scenario according to the present invention, unmatching wagers win for the same suit, tie for the same color, and lose for different colors.

The preferred use of multiple decks creates the possibility of same suit and rank for the two cards. Also, more decks used increases the frequency of the two cards being the same rank, so a variety of possible house advantages are available.

In accordance with an exemplary embodiment of the invention, a method of playing a casino card game using at least one deck of cards, with each card having a suit and a rank, includes the steps of (a) receiving at least one wager from a player that a stake hand will appear in a first position or a second position, (b) dealing a first hand in the first position, and dealing a second hand in the second position, and (c) resolving wagers according to game rules. In this context, when the first hand is different from the second hand, wagers matching the first hand in the first position and wagers matching the second hand in the second position win, and wagers matching the first hand in the second position and wagers matching the second hand in the first position lose. Additionally, when the first hand is equivalent to the second hand, wagers matching both the first hand in the first position and the first hand in the second position or wagers matching both the second hand in the first position and the second hand in the second position win, and unmatching wagers are resolved according to characteristics of the first hand and the second hand.

When neither the first hand nor the second hand matches the stake hand, step (c) is preferably practiced by maintaining the wager in play for a next round. The first hand preferably consists of a first card, and the second hand preferably consists of a second card. The characteristics of the first hand and the second hand may include at least one of card suit and card color. Unmatching wagers may be paid when the first card and the second card are of a same suit. When these cards are of a same color, the unmatching wagers are preferably pushed, and when the first card and the second card are of a different color, the unmatching wagers are preferably taken.

The stake hand is preferably a hand having predetermined characteristics, including at least one of card rank, card suit, card color, and whether the card is odd or even. Alternatively, the predetermined characteristics may include at least one of hand rank, and a numerical computation with reference to prescribed rankings of high/low or odd/even. This hand rank may be defined according to poker combinations.

Step (a) may be practiced by requiring a player to wager on both the first hand in the first position and the second hand in the second position. Preferably, winning wagers are paid 1 to 1. One or more proposition wager areas may also be provided to enable the players to wager that the first card/hand and the second card/hand will have a preset relationship, such as same rank, suit or both or a specific same rank or the like. In one embodiment, winning the same rank proposition wager pays 10 to 1, while winning the specific same rank proposition wager pays 25 to 1.

In accordance with another aspect of the invention, an apparatus configured for playing a card game includes a display, a player interface for receiving player input, and a processor configured to effect game play, wherein the processor enables the method according to the present invention.

In accordance with yet another aspect of the invention, an apparatus configured for playing a card game includes a display, a player interface for receiving player input, and circuitry for effecting game play. The apparatus includes structure for receiving at least one wager from a player that a stake hand will appear in a first position or a second position, structure for dealing a first hand in the first position and dealing a second hand in the second position, and structure for resolving wagers according to game rules, such as those discussed above.

In accordance with still another aspect of the invention, a casino card game includes at least one deck of cards, with each card having a suit and a rank, and a game table. The game table includes a dealer area having a first hand position for a first dealt hand and a second hand position for a second dealt hand, and a plurality of player betting areas for placing at least one wager that a stake hand will appear in the first hand position or the second hand position. Wagers are resolved according to game rules, such as those discussed above.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

In the following detailed description, the method and apparatus according to the present invention will be described in conjunction with its application to a casino environment, thus incorporating wagers, payouts, etc. Those of ordinary skill in the art will readily comprehend alternative applications of the present invention outside a casino environment, and the invention is not meant to be limited to the described application. For example, the game may be embodied in a video game that is played for entertainment purposes against a computer or the like. Alternatively, players may play the game without wagers in a head-to-head format with one player acting as a dealer, and the other players simply keeping track of wins and losses.

Figure 1:
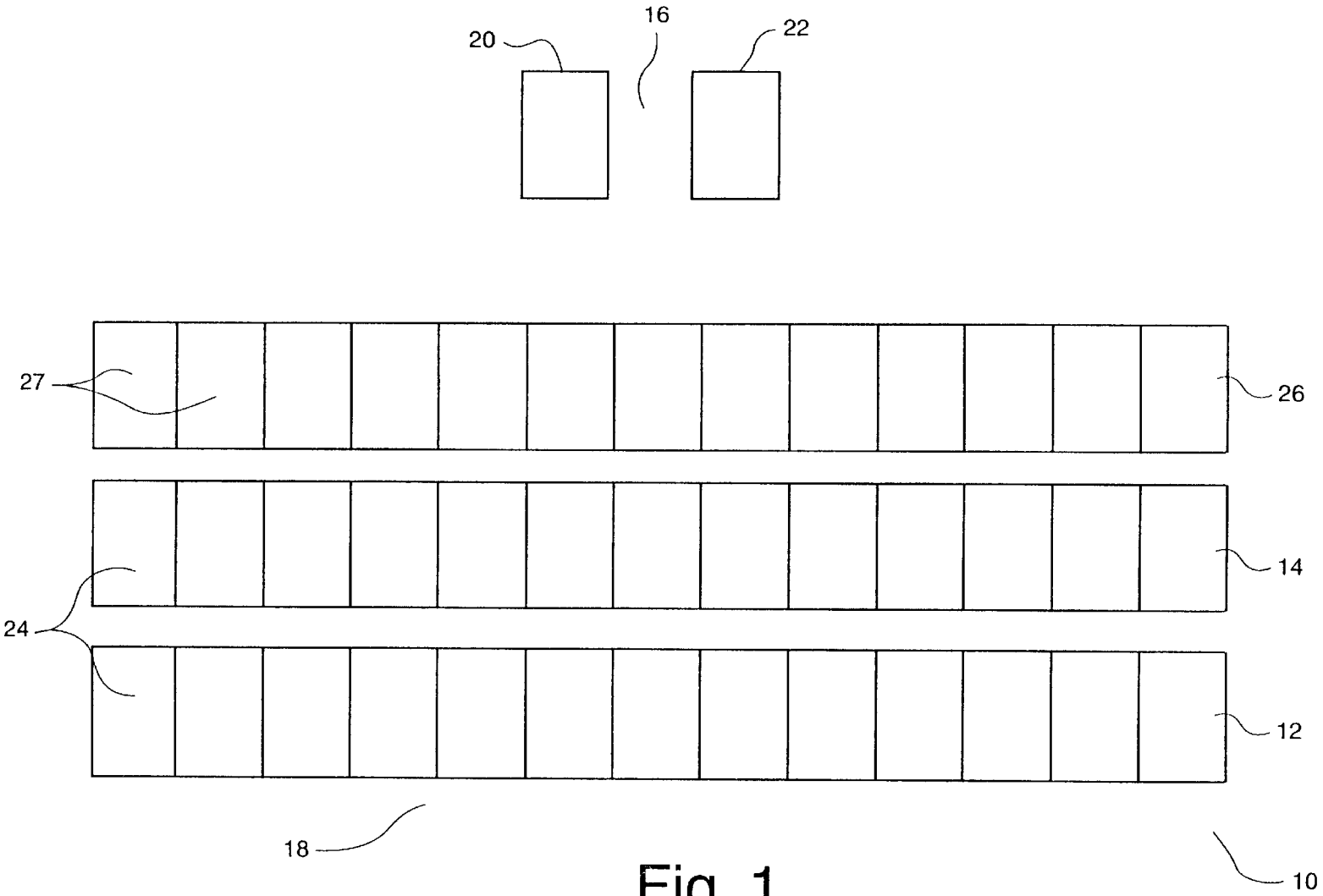
FIG. 1 is a plan view of a table arrangement according to the present invention.

FIG. 1 shows a game table including a playing area 10 with communal betting areas 12 and 14 for a first card or hand and a second card or hand, respectively. Playing area 10 also includes a dealer area 16 and rules area 18 for game rules and payoffs. The dealer area 16 includes two additional areas 20 and 22 for each of the first card or hand and second card or hand, respectively. Each of the betting areas 12, 14 contains thirteen sub-areas 24 for individual rank wagers, corresponding to the thirteen standard ranks (two-Ace) of each suit in a standard 52-card deck of playing cards. Of course, modified or otherwise non-standard decks may also be used.

The game is commenced by receiving at least one wager at the sub-areas 24 from a player that a particular rank card will appear in a first position or a second position. After wagers are placed, the dealer deals a first card into area 20 and a second card into area 22. Subsequently, wagers are resolved according to game rules. In resolving wagers, two consequences are addressed (1) when the first card is different from the second card, and (2) when the first card is equivalent to the second card. In the first instance, wagers matching the first card in the first position and wagers matching the second card in the second position win and are paid, for example, 1 to 1. Wagers matching the first card in the second position and wagers matching the second card in the first position lose, and the wagers are taken by the dealer. In a preferred embodiment, wagers for cards that do not appear as either the first card or the second card are maintained in play for a next round.

In the second instance, when the first card is equivalent to the second card, matching wagers, that is, wagers matching both the first card in the first position and the first card in the second position and vice versa, win; while unmatching wagers are resolved according to characteristics of the first card and the second card. For example, in a preferred embodiment, the unmatching wagers win and are paid, for example, 1 to 1, when the first card and the second card are of the same suit (i.e., with a standard deck of playing cards, the four suits include Spades, Clubs, Hearts and Diamonds). When the cards are the same color but not the same suit (i.e., Spades/Clubs or Hearts/Diamonds), the unmatching wagers push or tie, and when the cards are the opposite color, the unmatching wagers lose and are taken by the dealer. Of course, those of ordinary skill in the art will contemplate that alternative variations of this described theme could also be viable according to a desired house advantage. For example, other characteristics of the dealt cards may include card suit, card color, whether the card is odd or even, whether the card is high or low and the like.

In one embodiment, an individual player may wager on any number of card ranks in the thirteen sub-areas 24 for each of the betting areas 12, 14. In an alternative operating mode, the players may be required to wager on at least one card in both the first position 12 and the second position 14.

In yet another alternative, the playing area 10 includes a proposition wager area 26. The proposition wager area 26 includes thirteen sub-areas 27 corresponding to each card rank. A player may place a proposition wager at one of the sub-areas 27 that the first and second cards or hands are of a same rank, corresponding to which area 27 the wager is placed, and/or same rank and suit. Payouts may be increased according to the number of matching characteristics. In one preferred operating mode, the payout for winning wagers that the first card and second card will have a particular same rank is 25 to 1. In a similar context, in the event that the first and second card have the same rank, but not the rank corresponding to the player's proposition wager of sub-area 27, the proposition wager is deemed a winner nonetheless and is preferably paid 10 to 1. Preferably, the proposition wager cannot exceed a total of first card and second card wagers.

Additionally, although the preferred operating mode discussed above incorporates dealing a single first card and a single second card, in an alternative game, the dealer deals a first hand and a second hand in the areas 20 and 22, respectively. In this context, the wager from the player would be that a stake hand will appear in a first position or a second position. The stake hand in one embodiment is a hand having predetermined characteristics, including at least one of hand rank or a numerical computation with reference to prescribed rankings of high/low or odd/even. For example, the numerical computation may be determined according to the rules of Blackjack or Baccarat. The hand rank may be defined according to poker combinations. The hands may also be characterized by the existence or majority of cards having a particular suit, rank, color or whether odd or even. In the context of the embodiment where first and second hands are dealt, there are numerous variations and combinations for wagering as would be apparent to those of ordinary skill in the art, and the invention is not meant to be limited to any particular variation.

Still further, additional wager opportunities may be incorporated relating to card color, card suit, whether a card is high or low, whether a card is odd or even, or other possible propositions.

As would be apparent to those skilled in the relevant art, the invention can be embodied in a wide variety and forms of media such as, but not limited to, single player slot video machines, multi-player slot video machines, electronic games and devices, lottery terminals, scratch-card formats, software, as well as in-flight, home and Internet entertainment. In addition, the invention can be readily implemented as a computer program product (e.g., floppy disk, compact disk, etc.) comprising a computer readable medium having control logic recorded therein to implement the features of the invention as described in relation to the other preferred embodiments. Control logic can be loaded into the memory of a computer and executed by a central processing unit (CPU) to perform the operations described herein.

Figure 2:
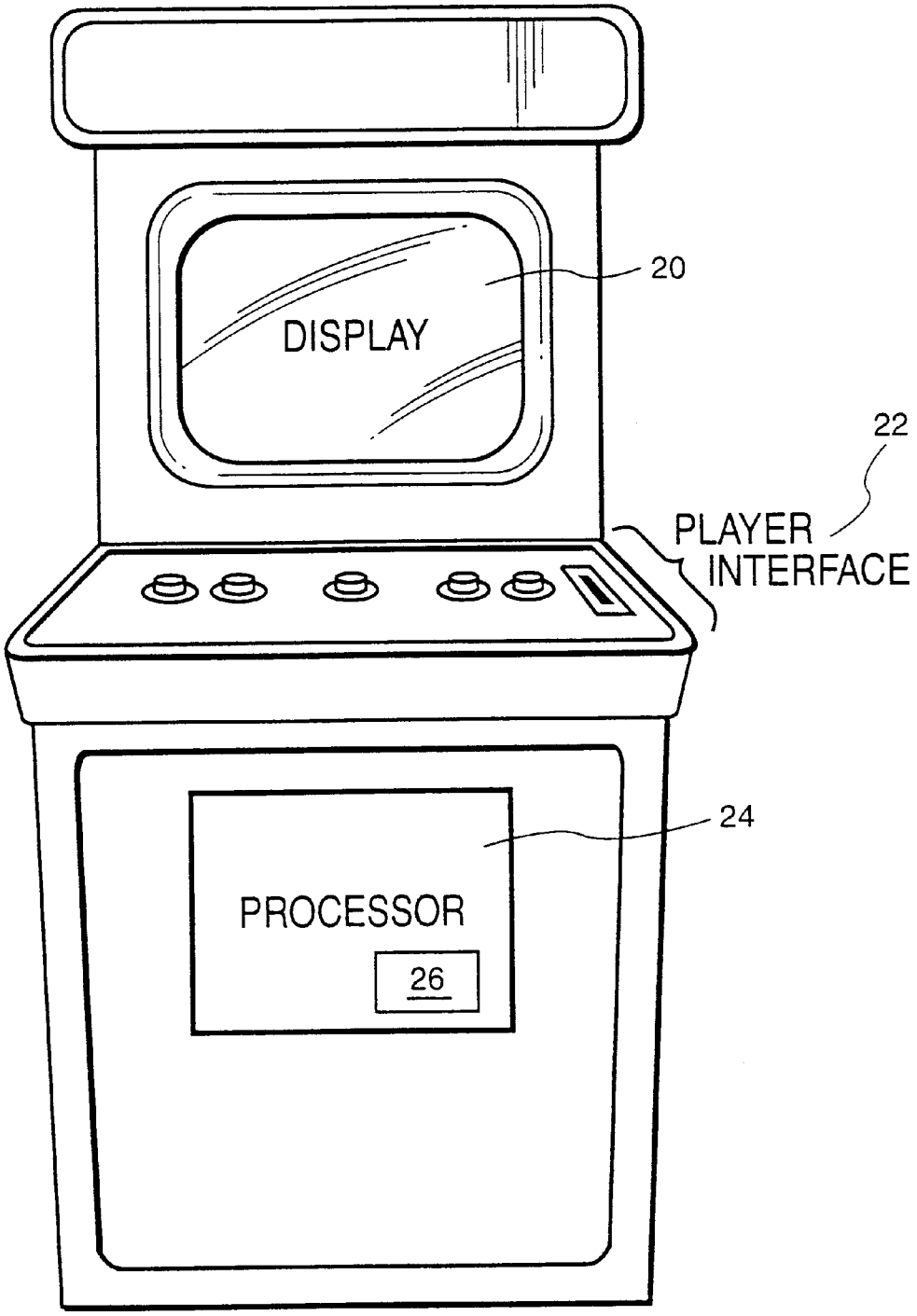
FIG. 2 is a block diagram illustrating the structure effecting game play according to the apparatus of the present invention.

In this context, referring to FIG. 2, a block diagram is illustrated showing the components of an apparatus configured for playing the game according to the invention. The apparatus includes a display 30, a player interface 32, and circuitry 34 for effecting game play and including structure for receiving wagers, dealing cards or hands and resolving wagers according to the game rules. That is, a processing circuit 34 is programmed to effect game play according to the rules of the game and resolves wagers based on the first and second cards or hands as necessary and according to the game outcome.

With the method and apparatus according to the present invention, the popular game of Faro is modified for a modem casino environment, incorporating a reasonable and consistent house advantage and a smooth method of operation. Game players will appreciate the ease of understanding and playing the game and apparent win frequency.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a casino card game using at least one deck of cards, with each card having a suit and a rank, the method comprising:

(a) receiving at least one wager from a player that a stake hand will appear in a first position or a second position;

(b) dealing a first hand in the first position, and dealing a second hand in the second position; and (c) resolving wagers according to game rules, (c1) wherein when the first hand is different from the second hand, wagers matching the first hand in the first position and wagers matching the second hand in the second position win, and wagers matching the first hand in the second position and wagers matching the second hand in the first position lose, and (c2) wherein when the first hand is equivalent to the second hand, wagers matching both the first hand in the first position and the first hand in the second position or wagers matching both the second hand in the first position and the second hand in the second position win, and unmatching wagers are resolved according to characteristics of the first hand and the second hand.

2. A method according to claim 1, wherein when neither the first hand nor the second hand matches the stake hand, step (c) is practiced by maintaining the at least one wager in play for a next round.

3. A method according to claim 1, wherein the first hand consists of a first card and the second hand consists of a second card.

4. A method according to claim 3, wherein the characteristics of the first hand and the second hand comprise at least one of card suit and card color.

5. A method according to claim 4, wherein step (c2) is practiced by paying unmatching wagers when the first card and the second card are of a same suit.

6. A method according to claim 5, wherein step (c2) is further practiced by pushing unmatching wagers when the first card and the second card are of a same color.

7. A method according to claim 6, wherein step (c2) is further practiced by taking unmatching wagers when the first card and the second card are of a different color.

8. A method according to claim 3, wherein the stake hand is a hand having predetermined characteristics, including at least one of card rank, card suit, card color, and whether the card is odd or even.

9. A method according to claim 1, wherein the stake hand is a hand having predetermined characteristics, including at least one of hand rank, and a numerical computation with reference to prescribed rankings of high/low or odd/even.

10. A method according to claim 9, wherein the hand rank is defined according to poker combinations.

11. A method according to claim 1, wherein the characteristics of the first hand and the second hand comprise at least one of a numerical computation and hand rank.

12. A method according to claim 11, wherein the hand rank is defined according to poker combinations.

13. A method according to claim 1, wherein step (a) is practiced by requiring the player to wager on both the first hand in the first position and the second hand in the second position.

14. A method according to claim 1, wherein step (c) is practiced by paying 1 to 1 on winning wagers.

15. A method according to claim 1, further comprising, prior to step (b), receiving a proposition wager that the first hand and the second hand will have a predetermined relationship.

16. A method according to claim 15, wherein the first hand consists of a first card and the second hand consists of a second card, and wherein the predetermined relationship is based on the characteristics of the first card and the second card.

17. A method according to claim 16, wherein one of the characteristics is card rank, and wherein the step of receiving a proposition wager comprises receiving a proposition wager that the first card and the second card will have any same rank.

18. A method according to claim 17, further comprising paying a payout of 10 to 1 for winning the proposition wager that the first card and the second card will have any same rank.

19. A method according to claim 16, wherein one of the characteristics is card rank, and wherein the step of receiving a proposition wager comprises receiving a proposition wager that the first card and the second card will have a particular same rank.

20. A method according to claim 19, further comprising paying a payout of 25 to 1 for winning the proposition wager that the first card and the second card will have a particular same rank.

21. An apparatus configured for playing a card game comprising a display, a player interface for receiving player input, and a processor configured to effect game play, the processor enabling:

(a) receiving at least one wager from a player that a stake hand will appear in a first position or a second position;

(b) dealing a first hand in the first position, and dealing a second hand in the second position; and (c) resolving wagers according to game rules, (c1) wherein when the first hand is different from the second hand, wagers matching the first hand in the first position and wagers matching the second hand in the second position win, and wagers matching the first hand in the second position and wagers matching the second hand in the first position lose, and (c2) wherein when the first hand is equivalent to the second hand, wagers matching both the first hand in the first position and the first hand in the second position or wagers matching both the second hand in the first position and the second hand in the second position win, and unmatching wagers are resolved according to characteristics of the first hand and the second hand.

22. An apparatus according to claim 21, wherein when neither the first hand nor the second hand matches the stake hand, step (c) is practiced by maintaining the at least one wager in play for a next round.

23. An apparatus according to claim 21, wherein the first hand consists of a first card and the second hand consists of a second card.

24. An apparatus according to claim 23, wherein the characteristics of the first hand and the second hand comprise at least one of card suit and card color.

25. An apparatus according to claim 24, wherein step (c2) is practiced by paying unmatching wagers when the first card and the second card are of a same suit.

26. An apparatus according to claim 25, wherein step (c2) is further practiced by pushing unmatching wagers when the first card and the second card are of a same color.

27. An apparatus according to claim 26, wherein step (c2) is further practiced by taking unmatching wagers when the first card and the second card are of a different color.

28. An apparatus according to claim 23, wherein the stake hand is a hand having predetermined characteristics, including at least one of card rank, card suit, card color, and whether the card is odd or even.

29. An apparatus according to claim 21, wherein the stake hand is a hand having predetermined characteristics, including at least one of hand rank, and a numerical computation with reference to prescribed rankings of high/low or odd/even.

30. An apparatus according to claim 29, wherein the hand rank is defined according to poker combinations.

31. An apparatus according to claim 21, wherein the characteristics of the first hand and the second hand comprise at least one of a numerical computation and hand rank.

32. An apparatus according to claim 31, wherein the hand rank is defined according to poker combinations.

33. An apparatus according to claim 21, wherein step (a) is practiced by requiring the player to wager on both the first hand in the first position and the second hand in the second position.

34. An apparatus according to claim 21, wherein step (c) is practiced by paying 1 to 1 on winning wagers.

35. An apparatus according to claim 21, further comprising, prior to step (b), receiving a proposition wager that the first hand and the second hand will have a predetermined relationship.

36. An apparatus according to claim 35, wherein the first hand consists of a first card and the second hand consists of a second card, and wherein the predetermined relationship is based on the characteristics of the first card and the second card.

37. An apparatus according to claim 36, wherein one of the characteristics is card rank, and wherein the step of receiving a proposition wager comprises receiving a proposition wager that the first card and the second card will have any same rank.

38. An apparatus according to claim 37, further comprising paying a payout of 10 to 1 for winning the proposition wager that the first card and the second card will have any same rank.

39. An apparatus according to claim 36, wherein one of the characteristics is card rank, and wherein the step of receiving a proposition wager comprises receiving a proposition wager that the first card and the second card will have a particular same rank.

40. An apparatus according to claim 39, further comprising paying a payout of 25 to 1 for winning the proposition wager that the first card and the second card will have a particular same rank.

41. An apparatus configured for playing a card game comprising a display, a player interface for receiving player input, and circuitry for effecting game play and comprising:

means for receiving at least one wager from a player that a stake hand will appear in a first position or a second position;

means for dealing a first hand in the first position, and dealing a second hand in the second position; and means for resolving wagers according to game rules, (1) wherein when the first hand is different from the second hand, wagers matching the first hand in the first position and wagers matching the second hand in the second position win, and wagers matching the first hand in the second position and wagers matching the second hand in the first position lose, and (2) wherein when the first hand is equivalent to the second hand, wagers matching both the first hand in the first position and the first hand in the second position or wagers matching both the second hand in the first position and the second hand in the second position win, and unmatching wagers are resolved according to characteristics of the first hand and the second hand.

42. A casino card game comprising:

at least one deck of cards, with each card having a suit and a rank; and a game table including:

a dealer area having a first hand position for a first dealt hand and a second hand position for a second dealt hand, and a plurality of player betting areas for placing at least one wager that a stake hand will appear in the first hand position or the second hand position, wherein wagers are resolved according to game rules, such that:

(1) when the first hand is different from the second hand, wagers matching the first hand in the first position and wagers matching the second hand in the second position win, and wagers matching the first hand in the second position and wagers matching the second hand in the first position lose, and (2) when the first hand is equivalent to the second hand, wagers matching both the first hand in the first position and the first hand in the second position or wagers matching both the second hand in the first position and the second hand in the second position win, and unmatching wagers are resolved according to characteristics of the first hand and the second hand.

43. A casino card game according to claim 42, wherein the game table further comprises a proposition wager area for receiving a proposition wager that the first hand and the second hand will have a predetermined relationship.

44. A casino card game according to claim 43, wherein the proposition wager area comprises a first proposition wager area including a plurality of sub-areas corresponding to specific card ranks, and a second proposition wager area for general proposition wagers not limited to a specific card rank.

* * * * *